US007024875B2

(12) United States Patent
Ochiai

(10) Patent No.: US 7,024,875 B2
(45) Date of Patent: Apr. 11, 2006

(54) AIR CONDITIONING APPARATUS USING VARIABLE DISPLACEMENT COMPRESSOR

(75) Inventor: Yoshihiro Ochiai, Isesaki (JP)

(73) Assignee: Sanden Corporation, Gunma (JP)

( * ) Notice: Subject to any disclaimer, the term of this patent is extended or adjusted under 35 U.S.C. 154(b) by 33 days.

(21) Appl. No.: 10/502,341

(22) PCT Filed: Jun. 12, 2003

(86) PCT No.: PCT/JP03/07475

§ 371 (c)(1),
(2), (4) Date: Jul. 23, 2004

(87) PCT Pub. No.: WO2004/010059

PCT Pub. Date: Jan. 29, 2004

(65) Prior Publication Data

US 2005/0034469 A1 Feb. 17, 2005

(30) Foreign Application Priority Data

Jul. 23, 2002 (JP) ..... 2002-213287

(51) Int. Cl.
*F25B 1/00* (2006.01)

(52) U.S. Cl. ..... 62/228.3

(58) Field of Classification Search ..... 62/228.1, 62/228.3, 228.5, 328.6, 132, 211; 417/42
See application file for complete search history.

(56) References Cited

U.S. PATENT DOCUMENTS 6,138,468 A * 10/2000 Yokomachi et al. ..... 62/228.5
6,152,845 A * 11/2000 Okada et al. ..... 474/93
6,164,925 A * 12/2000 Yokomachi et al. ..... 417/222.2
6,213,727 B1 * 4/2001 Kawaguchi ..... 417/222.2
6,224,348 B1 * 5/2001 Fukanuma et al. ..... 417/222.2
6,290,468 B1 * 9/2001 Kato et al. ..... 417/222.2
6,293,117 B1 * 9/2001 Ban et al. ..... 62/228.3
6,358,016 B1 * 3/2002 Hidaka et al. ..... 417/222.2
6,379,120 B1 * 4/2002 Adaniya et al. ..... 417/222.1
6,412,294 B1 * 7/2002 Kimura et al. ..... 62/228.3
6,449,965 B1 * 9/2002 Murao et al. ..... 62/133
6,457,319 B1 * 10/2002 Ota et al. ..... 62/228.3
6,481,225 B1 * 11/2002 Kimura et al. ..... 62/133

FOREIGN PATENT DOCUMENTS

| | | | |
|---|---|---|---|
| EP | 1101639 | | 5/2001 |
| EP | 1162370 | | 12/2001 |
| JP | 5118717 | | 5/1993 |
| JP | 2000-158939 A | * | 6/2000 |
| JP | 2001-133053 A | * | 5/2001 |
| JP | 2001140767 | | 5/2001 |

* cited by examiner

*Primary Examiner*—Mohammad M. Ali
(74) *Attorney, Agent, or Firm*—Baker Botts L.L.P.

(57) ABSTRACT

In an air conditioner provided with a refrigerant circulation circuit having a variable displacement compressor (11), there is provided a flow rate sensor (21) for detecting a collision force of a refrigerant flowing in the refrigerant circulation circuit to produce a collision force detection value. A discharge capacity of the variable displacement compressor is controlled referring to the collision force detection value. It may also be possible to control a discharge capacity such that a valve portion serving to introduce a discharged refrigerant into a crank chamber is applied with a collision force of the refrigerant and an electromagnetic force in opposite directions and, when the collision force is greater than the electromagnetic force, the valve portion is opened to cause the collision force to approach the electromagnetic force.

31 Claims, 6 Drawing Sheets

AIR CONDITIONING APPARATUS USING VARIABLE DISPLACEMENT COMPRESSOR

TECHNICAL FIELD

The present invention relates to an air conditioner provided with a refrigerant circulation circuit including a variable capacity compressor and, in particular, relates to a control of a discharge capacity.

BACKGROUND ART

In an air conditioner of this type, it is important to detect and control a circulation amount of refrigerant flowing in a refrigerant circulation circuit, i.e. a refrigerant circulation amount. Japanese Patent Application Publication No. 2001-140767, for example, discloses an air conditioner wherein two pressure monitoring points are provided in a refrigerant circulation circuit including a variable capacity compressor, and a refrigerant circulation amount is controlled using a correlation between a differential pressure between those pressure monitoring points, and the refrigerant circulation amount. Specifically, the differential pressure between the pressure monitoring points is detected, and a discharge capacity of the variable capacity compressor is feedback controlled so that the detected differential pressure approaches a control target value.

For stably executing the feedback control, it is essential to detect the differential pressure between the two pressure monitoring points with high accuracy. For improving the detection accuracy of the differential pressure, it is considered to prolong a distance between two pressure monitoring points 2 and 3 in a refrigerant circulation circuit 1 as shown in FIG. 1, or to provide a restrictor 4 in the refrigerant circulation circuit 1 as shown in FIG. 2. In the former case, either one of two conduit portions 6 and 7 for introducing pressures at the pressure monitoring points 2 and 3 to a differential pressure sensor 5 is made longer and, resultantly, an air conditioner becomes complicated. In the latter case, a pressure loss is generated due to the restrictor 4 so that the efficiency of the air conditioner is lowered.

For enabling the feedback control, the variable capacity compressor is provided with a control valve driven by an electromagnetic force. In order to use the foregoing differential pressure as a force to directly counter the electromagnetic force of the control valve, a pressure transmitting passage becomes necessary for introducing the pressure at one of the two pressure monitoring points to the variable capacity compressor. Such a pressure transmitting passage makes intricate a design for the variable capacity compressor.

It is therefore an object of the present invention to provide an air conditioner that can control a refrigerant circulation amount in a refrigerant circulation circuit with a simple structure and without lowering the efficiency.

DISCLOSURE OF THE INVENTION

According to one mode of the present invention, there is obtained an air conditioner provided with a refrigerant circulation circuit including a variable capacity compressor, said air conditioner characterized by comprising collision force detecting means for detecting a collision force of a refrigerant flowing in said refrigerant circulation circuit to produce a collision force detection value, and discharge capacity control means for controlling a discharge capacity of said variable capacity compressor by referring to said collision force detection value.

According to another mode of the present invention, there is obtained an air conditioner provided with a refrigerant circulation circuit including a variable capacity compressor, said air conditioner characterized by comprising a collision plate subjected to collision with a refrigerant flowing in said refrigerant circulation circuit, and a valve portion adapted to introduce discharged gas into a crank chamber, said valve portion provided to a rod through which an electromagnetic force is exerted to said collision plate, wherein when a force exerted to said collision plate by the collision with the refrigerant is greater than said electromagnetic force, said valve portion is opened to control a discharge capacity of said variable capacity compressor such that the force exerted to said collision plate approaches said electromagnetic force.

BEST MODE FOR CARRYING OUT THE INVENTION

Figure 1:
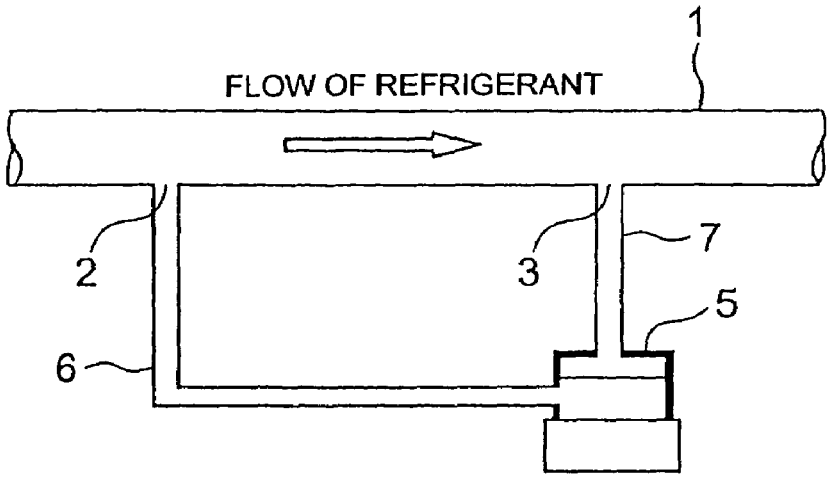
FIG. 1 is an explanatory diagram of one example of a method of detecting a differential pressure between two pressure monitoring points in a refrigerant circulation circuit.
Figure 2:
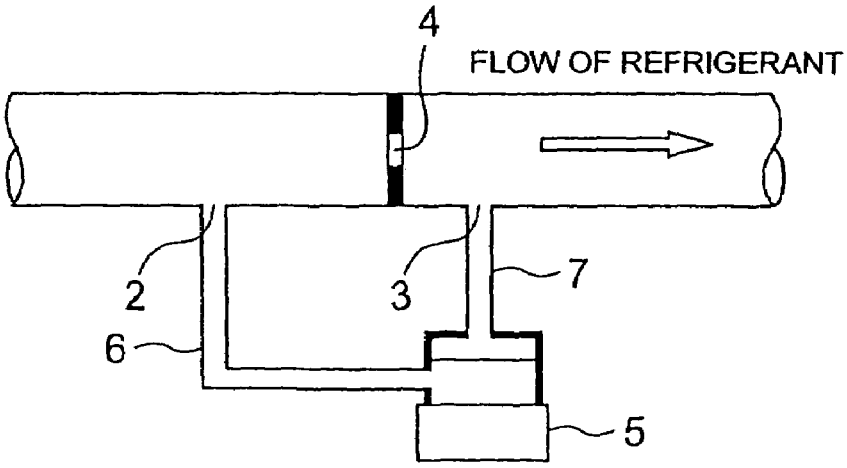
FIG. 2 is an explanatory diagram of another example of a method of detecting a differential pressure between two pressure monitoring points in a refrigerant circulation circuit.

At the outset, for facilitating understanding of the present invention, a relationship between a force received by an object in a fluid and a flow rate of the fluid will be explained.

It is known that, with respect to a flowing fluid, a correlation represented by an equation (1) is established among a force F received by an object in the fluid, a density ρ of the fluid, a flow rate Q, and a flow velocity v.

$$F \propto \rho Q v \tag{1}$$

A relationship of an equation (2) is established among the flow velocity v, the flow rate Q, and an area A of a flow passage.

$$v = Q/A \tag{2}$$

Here, assuming that the flow passage has a circular shape in cross section with a diameter d, the area A of the flow passage is expressed by an equation (3).

$$A = \pi d^2/4 \tag{3}$$

By putting the equation (3) into the equation (2) for substitution, an equation (4) is obtained.

$$v = Q/(\pi d^2/4) \tag{4}$$

By putting the equation (4) into the equation (1) for substitution, there is obtained:

$$F \propto \rho Q^2/(\pi d^2/4) \tag{5}$$

From the equation (5), the flow rate Q is given as:

$$Q \hat{a} \sqrt{[F(\Pi d^2/4)/\rho]} \quad (6)$$

Since the density ρ of the fluid can be derived from a pressure and a temperature of the fluid, the flow rate Q can be derived by measuring the force F received by the object. That is, it is represented that the force F received by the object serves as an index for presuming the flow rate.

Figure 3:
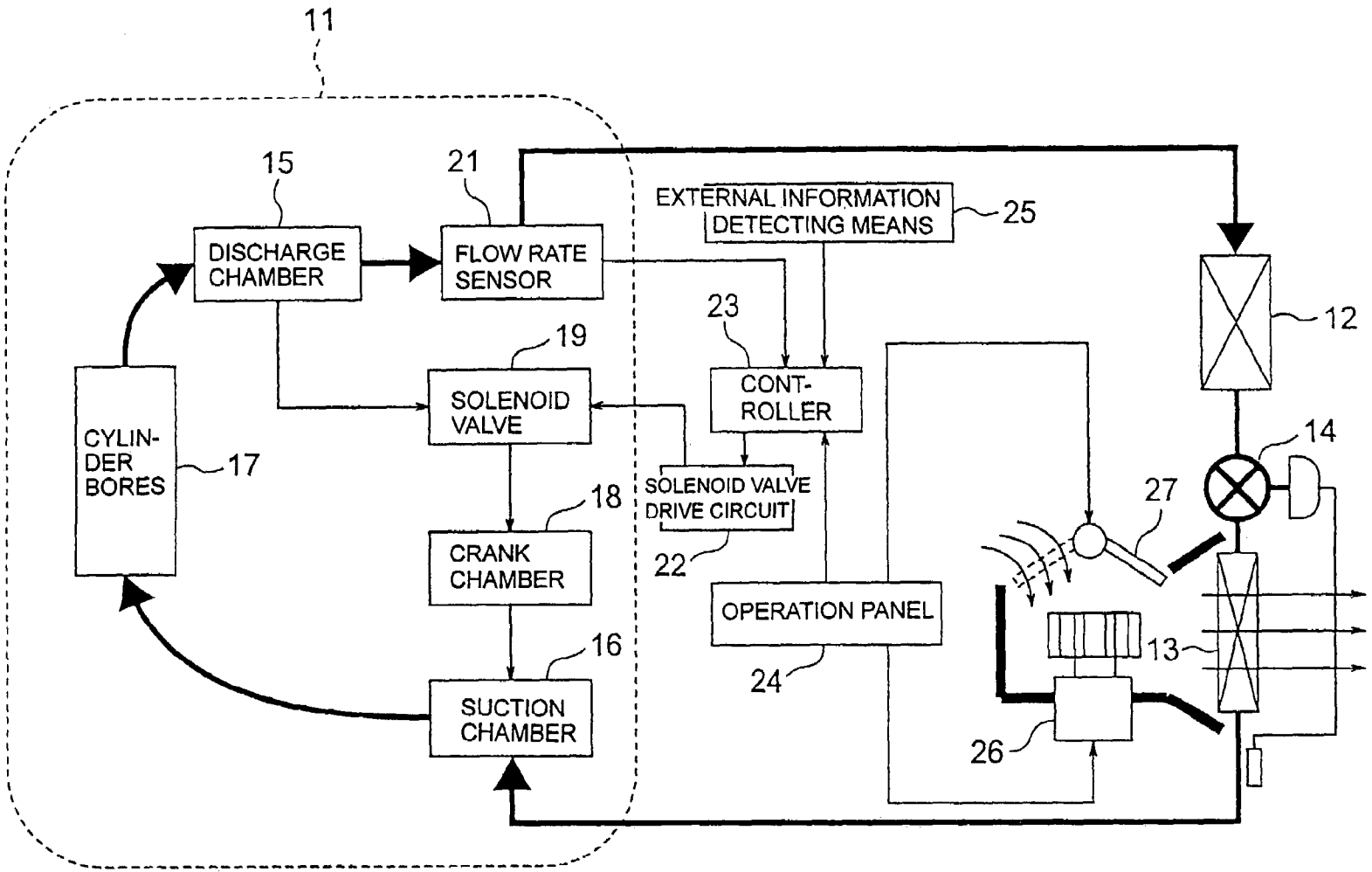
FIG. 3 is a conceptual diagram of an air conditioner according to a first embodiment of the present invention.

Referring now to FIG. 3, the whole of an air conditioner according to a first embodiment of the present invention will be described.

An air conditioner in FIG. 3 is a vehicle air conditioner and includes a refrigerant circulation circuit comprising a variable displacement swash plate compressor 11 and an external refrigerant circuit. The external refrigerant circuit comprises a condenser 12 connected to the discharge side of the compressor 11, an evaporator 13 connected to the suction side of the compressor 11, and an expansion valve connected between the condenser 12 and the evaporator 13.

As is well known, the variable displacement swash plate compressor 11 comprises a discharge chamber 15 connected to the condenser 12, a suction chamber 16 connected to the evaporator 13, cylinder bores 17 interposed between the discharge chamber 15 and the suction chamber 16, a crank chamber 18 provided therein with a crank mechanism (not shown) for a cam (swash plate etc.) for reciprocating pistons (not shown) within the cylinder bores 17, and a solenoid valve 19 inserted in a path connecting the discharge chamber 15 to the crank chamber 18. The solenoid valve 19 serves to control a pressure in the crank chamber 18 to change a discharge capacity of the variable displacement swash plate compressor 11 according to the well known principle. The compressor 11 further comprises a flow rate sensor 21 connected to the outlet side of the discharge chamber 15.

The air conditioner in FIG. 3 further comprises a solenoid valve drive circuit 22 for driving the solenoid valve 19, a controller 23 for controlling an operation of the solenoid valve drive circuit 22, an operation panel 24 and external information detecting means 25 that are connected to the controller 23, and a blower motor 26 and a damper 27 that are directly or indirectly driven by an operation of the operation panel 23. The blower motor 26 serves to facilitate heat exchange by sending air to the neighborhood around the evaporator 13. The damper 27 serves to control a sectional area of a blast path and a route.

Now, referring to FIG. 4 along with FIG. 3, the flow rate sensor 21 will be described.

The flow rate sensor 21 comprises a flow force detector 28 and a displacement sensor (position sensor) 29. The flow force detector 28 has a disc-shaped movable plate 31 that collides with a refrigerant discharged from the discharge chamber 15 to thereby detect a force of its flow, and a coil spring (elastic member) 32 urging the movable plate 31 in a direction against the flow of the refrigerant. The force caused by the flow of the refrigerant is exerted on the coil spring 32. The movable plate 31 moves to a position where the force caused by the flow of the refrigerant and a biasing force caused by the coil spring 32 are balanced with each other. That is, the movable plate 31 is displaced according to a force caused by a collision of the refrigerant.

The displacement sensor 29 is disposed so as to confront the movable plate 31 at an interval 33 therefrom, and outputs a collision force detection value depending on a change of the interval 33 following a displacement of the movable plate 31. By deriving the force caused by the flow of the refrigerant based on this collision force detection value, the refrigerant flow rate can be measured. Herein, the flow rate sensor 21 serves as collision force detecting means.

Incidentally, the coil spring 32 can be replaced with another elastic member that elastically supports the movable plate 31. Further, the movable plate 31 can be replaced with a deformable plate subjected to collision of the refrigerant and, in this case, the displacement sensor 29 is replaced with a deformation sensor that detects a deformation of the deformable plate.

Figure 4:
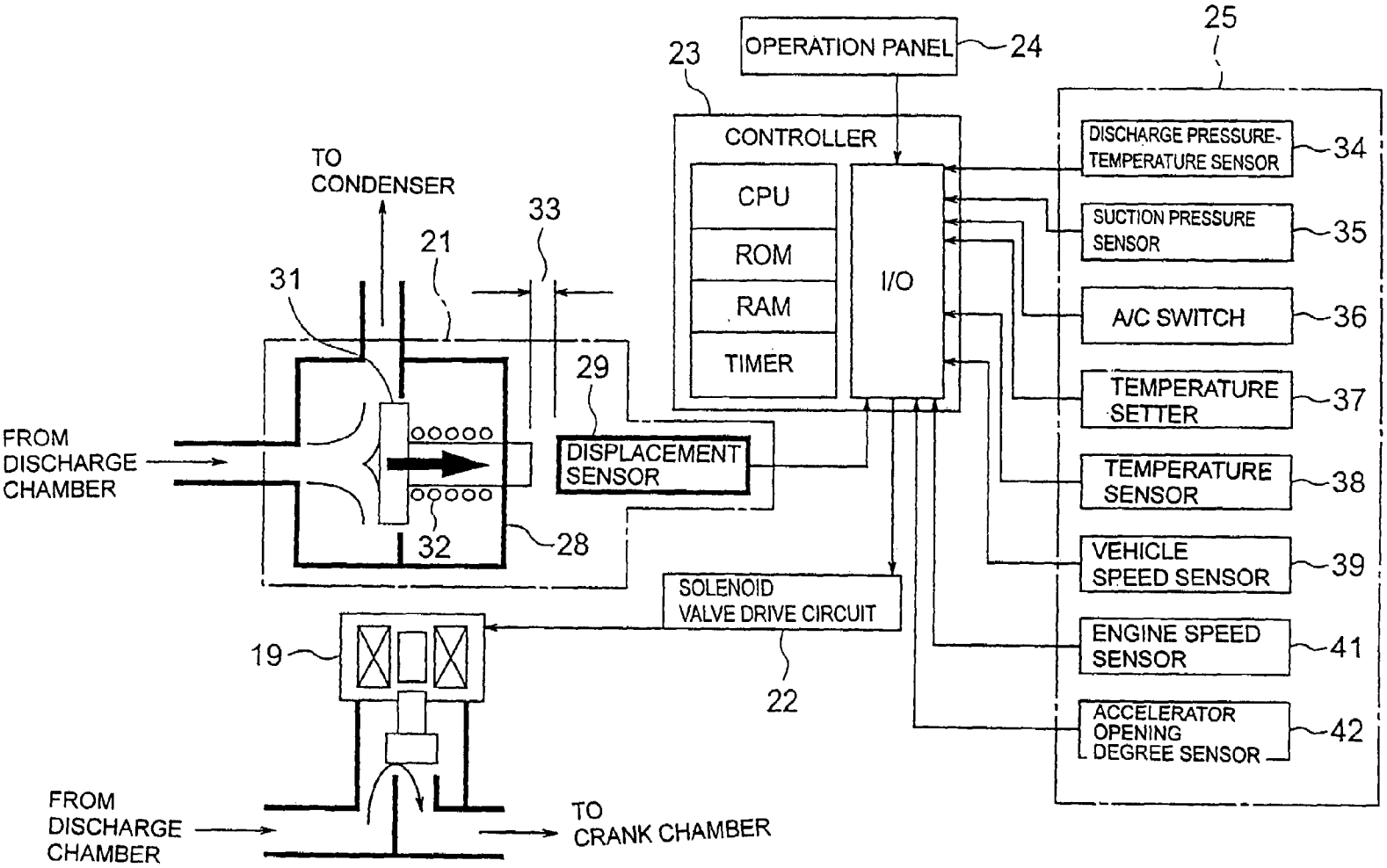
FIG. 4 is an explanatory diagram showing in detail the main part of the air conditioner in FIG. 3.

As shown in FIG. 4, the displacement sensor 29 is connected to the controller 23 along with the operation panel 24 and the external information detecting means 25, and inputs its detection value into the controller 23. The external information detecting means 25 includes a discharge pressure-temperature sensor 34, a suction pressure sensor 35, an A/C switch 36, a temperature setter 37, a temperature sensor 38, a vehicle speed sensor 39, an engine speed sensor 41, an accelerator opening degree sensor 42, and so forth, and output signals thereof are also inputted into the controller 23.

Now, a control of the discharge capacity of the compressor 11 will be described.

The controller 23 determines a control target refrigerant flow rate based on input signals from the external information detecting means 25, and calculates a refrigerant flow rate of the air conditioner referring to a detection value of the displacement sensor 29 and, simultaneously, compares it with the control target refrigerant flow rate. When the actual refrigerant flow rate is greater than the control target refrigerant flow rate, the controller 23 sends a signal to the solenoid valve drive circuit 22 to control the solenoid valve 19 such that an opening time of the solenoid valve 19 per unit time is prolonged. When the opening time of the solenoid valve 19 per unit time is prolonged, the pressure in the crank chamber 18 of the compressor 11 increases so that, as is well known, an inclination angle of the swash plate, i.e. a cam inclination angle, is reduced to decrease the discharge capacity, and therefore, the refrigerant flow rate is decreased. When the actual refrigerant flow rate is smaller than the control target refrigerant flow rate as a result of comparison with the control target refrigerant flow rate, the solenoid valve 19 is controlled to shorten an opening time of the solenoid valve 19 per unit time, so that the refrigerant flow rate is increased. In this manner, by executing the feedback control of the discharge capacity based on the actual refrigerant flow rate, it is possible to match the actual refrigerant flow rate to the control target refrigerant flow rate with high accuracy.

Shifting to FIG. 5, the whole of an air conditioner according to a second embodiment of the present invention will be described. Those portions that are the same as FIG. 3 are given the same reference symbols to thereby omit description thereof.

Figure 5:
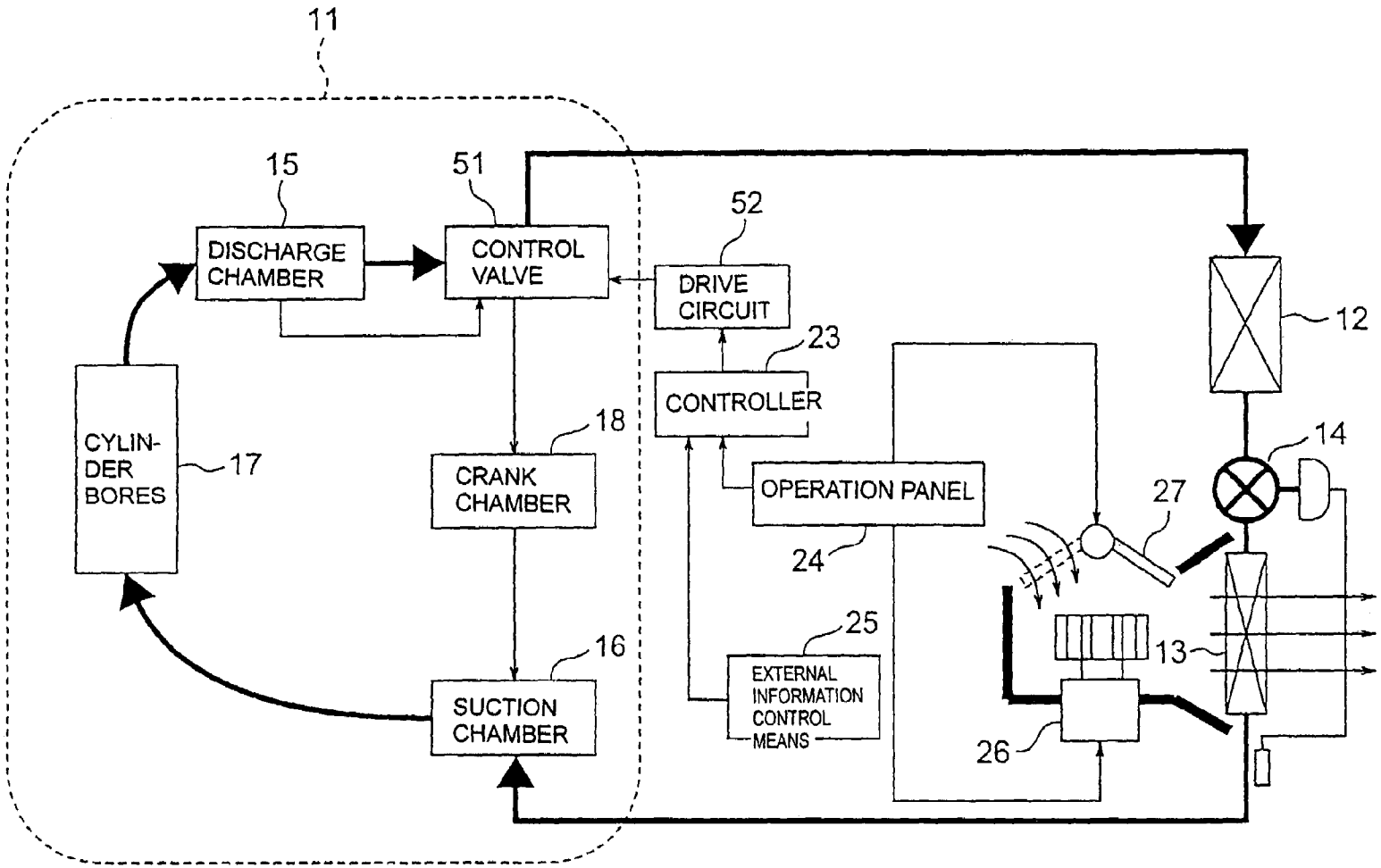
FIG. 5 is a conceptual diagram of an air conditioner according to a second embodiment of the present invention.

The air conditioner in FIG. 5 is provided with a control valve 51 between a discharge chamber 15, and a condenser 12 and a crank chamber 18, instead of the solenoid valve 19 and the flow rate sensor 21 in the air conditioner in FIG. 3. The control valve 51 serves to adjust the flow rate of the refrigerant headed toward the crank chamber 18 from the discharge chamber 15 by utilizing an electromagnetic force and balancing between such an electromagnetic force and a force caused by the flow of the discharged refrigerant from the discharge chamber 15, to thereby control the pressure in the crank chamber 18 and, according to the well known principle, serves to change the discharge capacity of the variable displacement swash plate compressor 11. A control valve drive circuit 52 for driving the control valve 51 is connected to the control valve 51. The control valve drive circuit 52 is also controlled to be driven by a controller 23.

Figure 6:
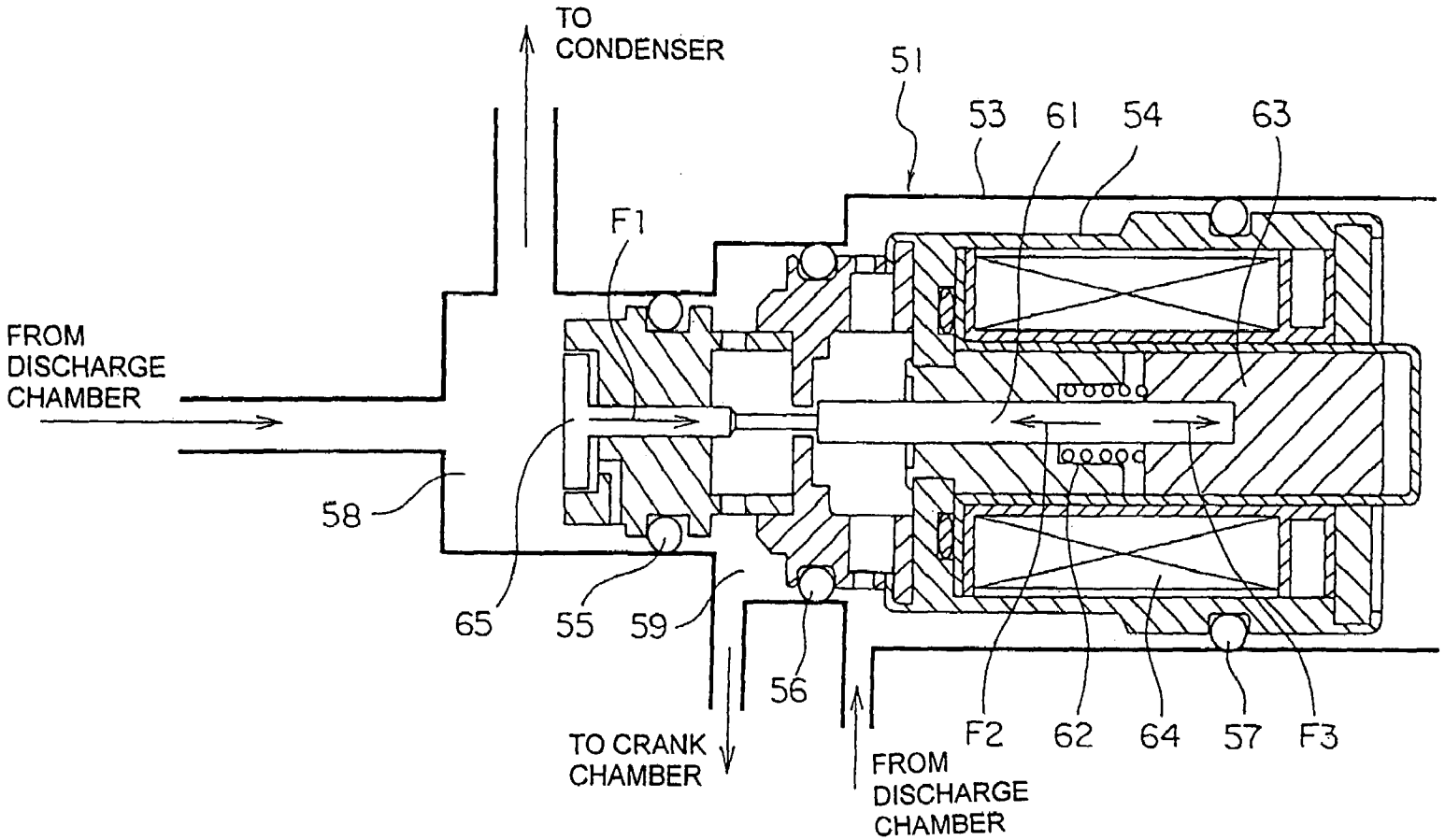
FIG. 6 is a sectional view showing in detail a control valve included in the air conditioner in FIG. 5.

Referring now to FIG. 6, the control valve 51 will be described.

The control valve 51 comprises a valve housing 53 connected to the condenser 12, the discharge chamber 15, and the crank chamber 18, a valve unit 54 inserted in the valve housing 53, and first, second, and third sealing members 55, 56, and 57 sealing between the valve housing 53 and the valve unit 54. By providing the sealing members 55, 56, and 57, there are formed a discharge passage 58 for leading the discharged gas from the discharge chamber 15 to the condenser 12 through the valve housing 53 without being influenced by an operation of the valve unit 54, and a control passage 59 for leading the discharged gas from the discharge chamber 15 to the crank chamber 18 while being controlled by the operation of the valve unit 54.

The valve unit 54 comprises a valve member (rod) 61 movable leftward and rightward in the figure to control opening/closing or the opening degree of the control passage 59, a spring 62 biasing the valve member 61 in an opening direction (rightward in the figure) of the control passage 59, a movable plunger 63 coupled to the valve member 61, a coil 64 for generating an electromagnetic force, when energized, to urge the plunger 63 to a closing direction (leftward in the figure) of the control passage 59, and a flow force detecting member (collision plate) 65 disposed in the discharge passage 58 and coupled to the valve member 61. The flow force detecting member 65 serves to detect a flow force of the refrigerant through a collision with the refrigerant discharged into the discharge passage 58 from the discharge chamber 15. Specifically, when the refrigerant collides, the flow force detecting member 65 urges the valve member 61 in the opening direction. Therefore, during operation of the compressor 11, the valve member 61 controls opening/closing or the opening degree of the control passage 59 to adjust the refrigerant flow rate in the state where a refrigerant flow force F1 detected at the flow force detecting member 65, an electromagnetic force F2 generated during energization of the coil 64, and a biasing force F3 of the spring 62 are balanced.

Figure 7:
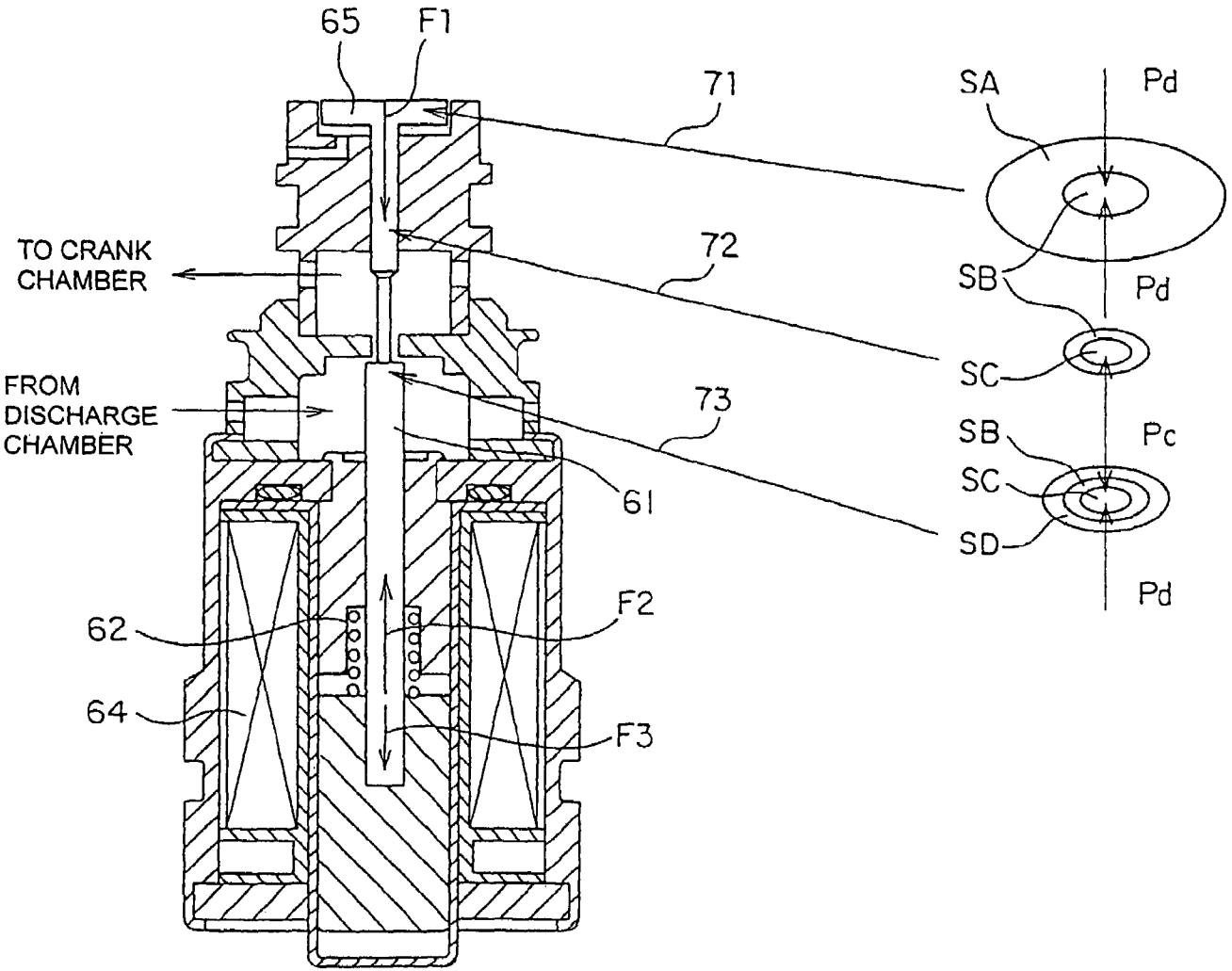
FIG. 7 is an explanatory diagram for explaining an operation of the control valve shown in FIG. 6.

Referring also to FIG. 7, an operation of the control valve 51 will be described.

The electromagnetic force caused by the coil 64 is determined based on signals inputted into the controller 23 from the external information detecting means 25 so as to achieve the following action. When the force caused by the flow of the refrigerant is greater than the electromagnetic force, the valve member 61 opens the control passage 59 (opens a valve portion) to allow the discharged gas to flow into the crank chamber 18, so that the crank chamber pressure increases to decrease the cam inclination angle to thereby reduce the discharge capacity, and therefore, the refrigerant flow rate is decreased. When the refrigerant flow rate is decreased, the force caused by the flow of the refrigerant is lowered to approach the electromagnetic force. In the reversed case, since the crank chamber pressure is lowered, the cam inclination angle increases to increase the discharge capacity, so that the refrigerant flow rate is increased, thereby approaching the force caused by the flow of the refrigerant. That is, it is possible to execute the feedback control of the discharge capacity of the variable displacement compressor based on the actual refrigerant flow rate.

A relationship among the refrigerant flow force F1, the electromagnetic force F2 caused by the coil 64, and the spring force F3 caused by the spring 62 is shown by an equation (7).

$$F1+Pd\times SA-Pd(SA-SB)-Pc(SB-SC)-F2+F3-Pd\times SD+Pc(SB-SC)+Pd(SD-SB)=0 \quad (7)$$

Herein, Pd represents a discharge chamber pressure, Pc a crank chamber pressure, and SA, SB, SC, and SD sectional areas of portions identified by arrows 71, 72, and 73, respectively.

By rearranging the equation (7), a relationship is given by $$F1=F2-F3 \quad (8)$$

Therefore, the refrigerant flow force and the electromagnetic force can be balanced with each other without receiving an influence of the gas pressure. Incidentally, the spring 62 is provided for the purpose of forcibly opening the valve member 61 to introduce the discharged gas into the crank chamber in order to maintain the discharge capacity of the variable displacement compressor at the minimum capacity by deenergizing the coil 64. Therefore, the biasing force thereof can be deemed constant within an opening/closing stroke of the valve member 61.

As described above, according to the present invention, in the variable capacity compressor, it becomes possible to recognize the flow rate of the compressor as an electrical signal by means of the flow rate sensor, so that a load adjustment of the engine or a control of the vehicle air conditioner can be highly advanced. Since the load applied to the compressor can be estimated from the refrigerant flow rate, damage to the compressor due to overload can be prevented. Further, based on comparison between the control target refrigerant flow rate and the actual refrigerant flow rate taking into account at least the compressor speed, if the actual refrigerant flow rate is much lower, it is possible to judge that there is possibility of leakage of the refrigerant. Since the leakage of the refrigerant can be predicted, it becomes possible to prevent burning of the compressor.

If detecting means for detecting a pressure on the low pressure side of the refrigerant circuit is added and means for switching between it and the feedback control by the flow rate sensor is provided, the optimum control where merits of the respective controls are brought out, is made possible, and therefore, it becomes possible to harmonize comfortableness and engine load reduction on a higher level. Particularly, in the low load region, the feedback control of the pressure on the low pressure side is preferable in terms of preventing frost formation on the evaporator. In the high load region, since the engine load is large, the feedback control of the refrigerant flow rate that can steadily lower the engine load upon rapid acceleration or the like, is preferable.

When the control valve structure is adopted, switching between the refrigerant leakage detection and the control means for the flow rate and suction pressure is difficult. However, the control valve can be easily attached to the compressor, a complicated differential pressure passage is unnecessary, and the structure of the control valve can be simplified. Therefore, it is possible to provide the compressor at a low price.

INDUSTRIAL APPLICABILITY

The air conditioner of the present invention is suitable as a vehicle air conditioner mounted on a vehicle such as an automobile.

The invention claimed is:

1. An air conditioner provided with a refrigerant circulation circuit including a variable capacity compressor, said air conditioner characterized by comprising collision force detecting means for detecting a collision force of a refrigerant flowing in said refrigerant circulation circuit to produce a collision force detection value, and discharge capacity control means for controlling a discharge capacity of said variable capacity compressor by referring to said collision force detection value.

2. An air conditioner according to claim 1, further comprising external information detecting means that can detect a change in refrigeration load as external information, wherein said discharge capacity control means determines a control target value about said collision force based on said external information, and executes a feedback control of said discharge capacity such that said collision force detection value approaches said control target value.

3. An air conditioner according to claim 1, wherein said collision force detecting means comprises a movable plate subjected to collision with the refrigerant, an elastic member elastically supporting said movable plate, and a displacement sensor for detecting a displacement of said movable plate.

4. An air conditioner according to claim 1, wherein said collision force detecting means comprises a deformable plate subjected to collision with the refrigerant, and a deformation sensor for detecting a deformation of said deformable plate.

5. An air conditioner according to claim 2, wherein said external information detecting means detects at least a low-pressure side pressure of said refrigerant circulation circuit as said external information, and said discharge capacity control means comprises target pressure determining means for determining a target pressure as said control target value based on said external information, and discharge capacity control means for enabling switching of said feedback control so as to make a comparison between said low-pressure side pressure and said target pressure to cause said low-pressure side pressure to approach said target pressure.

6. An air conditioner according to claim 2, further comprising refrigerant shortage detecting means for detecting a shortage of the refrigerant in said refrigerant circulation circuit by the use of a speed signal of said variable capacity compressor, said collision force detection value, and said control target value.

7. An air conditioner according to claim 6, wherein said refrigerant shortage detecting means comprises means for deriving a difference between said control target value and said collision force detection value, and means for judging whether or not the refrigerant is insufficient, based on said difference and said speed signal.

8. An air conditioner according to claim 1, wherein said variable capacity compressor comprises a suction chamber, a discharge chamber, and a crank chamber, and said discharge capacity control means comprises a pressure relief passage connecting between said crank chamber and said suction chamber, a solenoid valve disposed in a passage serving to lead gas in said discharge chamber into said crank chamber, and means for driving said solenoid valve based on said collision force detection value to adjust a pressure in said crank chamber.

9. An air conditioner according to claim 1, wherein said variable capacity compressor comprises a suction chamber, a discharge chamber, and a crank chamber, and said discharge capacity control means comprises a pressure relief passage connecting between said discharge chamber and said crank chamber, a solenoid valve disposed in a passage serving to lead gas in said crank chamber into said suction chamber, and means for driving said solenoid valve based on said collision force detection value to adjust a pressure in said crank chamber.

10. An air conditioner provided with a refrigerant circulation circuit including a variable capacity compressor, said air conditioner characterized by comprising a collision plate subjected to collision with a refrigerant flowing in said refrigerant circulation circuit, and a valve portion adapted to introduce discharged gas into a crank chamber, said valve portion provided to a rod through which an electromagnetic force is exerted to said collision plate, wherein when a force exerted to said collision plate by the collision with the refrigerant is greater than said electromagnetic force, said valve portion is opened to control a discharge capacity of said variable capacity compressor such that the force exerted to said collision plate approaches said electromagnetic force.

11. An air conditioner according to claim 10, wherein said valve portion is applied with a spring force so as to be opened when said electromagnetic force is shut off.

12. An air conditioner according to claim 10, wherein a gas pressure applied to said rod and a sectional area thereof are adjusted so that opening/closing of said valve portion is carried out only based on the collision force of the refrigerant exerted to said collision plate, said spring force, and said electromagnetic force.

13. An air conditioner according to claim 10, further comprising external information detecting means that can detect a change in refrigeration load as external information, wherein the electromagnetic force serving as a control target value is determined based on said external information, and the discharge capacity of said variable capacity compressor is feedback controlled such that the force exerted to said collision plate approaches said control target value.

14. An air conditioner according to claim 2, wherein said collision force detecting means comprises a movable plate subjected to collision with the refrigerant, an elastic member elastically supporting said movable plate, and a displacement sensor for detecting a displacement of said movable plate.

15. An air conditioner according to claim 2, wherein said collision force detecting means comprises a deformable plate subjected to collision with the refrigerant, and a deformation sensor for detecting a deformation of said deformable plate.

16. An air conditioner according to claim 3, further comprising refrigerant shortage detecting means for detecting a shortage of the refrigerant in said refrigerant circulation circuit by the use of a speed signal of said variable capacity compressor, said collision force detection value, and said control target value.

17. An air conditioner according to claim 16, wherein said refrigerant shortage detecting means comprises means for deriving a difference between said control target value and said collision force detection value, and means for judging whether or not the refrigerant is insufficient, based on said difference and said speed signal.

18. An air conditioner according to claim 4, further comprising refrigerant shortage detecting means for detecting a shortage of the refrigerant in said refrigerant circulation circuit by the use of a speed signal of said variable capacity compressor, said collision force detection value, and said control target value.

19. An air conditioner according to claim 18, wherein said refrigerant shortage detecting means comprises means for deriving a difference between said control target value and said collision force detection value, and means for judging whether or not the refrigerant is insufficient, based on said difference and said speed signal.

20. An air conditioner according to claim 5, further comprising refrigerant shortage detecting means for detecting a shortage of the refrigerant in said refrigerant circulation circuit by the use of a speed signal of said variable capacity compressor, said collision force detection value, and said control target value.

21. An air conditioner according to claim 20, wherein said refrigerant shortage detecting means comprises means for deriving a difference between said control target value and said collision force detection value, and means for judging whether or not the refrigerant is insufficient, based on said difference and said speed signal.

22. An air conditioner according to claim 14, further comprising refrigerant shortage detecting means for detecting a shortage of the refrigerant in said refrigerant circulation circuit by the use of a speed signal of said variable capacity compressor, said collision force detection value, and said control target value.

23. An air conditioner according to claim 22, wherein said refrigerant shortage detecting means comprises means for deriving a difference between said control target value and said collision force detection value, and means for judging whether or not the refrigerant is insufficient, based on said difference and said speed signal.

24. An air conditioner according to claim 15, further comprising refrigerant shortage detecting means for detecting a shortage of the refrigerant in said refrigerant circulation circuit by the use of a speed signal of said variable capacity compressor, said collision force detection value, and said control target value.

25. An air conditioner according to claim 24, wherein said refrigerant shortage detecting means comprises means for deriving a difference between said control target value and said collision force detection value, and means for judging whether or not the refrigerant is insufficient, based on said difference and said speed signal.

26. An air conditioner according to claim 2, wherein said variable capacity compressor comprises a suction chamber, a discharge chamber, and a crank chamber, and said discharge capacity control means comprises a pressure relief passage connecting between said crank chamber and said suction chamber, a solenoid valve disposed in a passage serving to lead gas in said discharge chamber into said crank chamber, and means for driving said solenoid valve based on said collision force detection value to adjust a pressure in said crank chamber.

27. An air conditioner according to claim 2, wherein said variable capacity compressor comprises a suction chamber, a discharge chamber, and a crank chamber, and said discharge capacity control means comprises a pressure relief passage connecting between said discharge chamber and said crank chamber, a solenoid valve disposed in a passage serving to lead gas in said crank chamber into said suction chamber, and means for driving said solenoid valve based on said collision force detection value to adjust a pressure in said crank chamber.

28. An air conditioner according to claim 11, wherein a gas pressure applied to said rod and a sectional area thereof are adjusted so that opening/closing of said valve portion is carried out only based on the collision force of the refrigerant exerted to said collision plate, said spring force, and said electromagnetic force.

29. An air conditioner according to claim 11, further comprising external information detecting means that can detect a change in refrigeration load as external information, wherein the electromagnetic force serving as a control target value is determined based on said external information, and the discharge capacity of said variable capacity compressor is feedback controlled such that the force exerted to said collision plate approaches said control target value.

30. An air conditioner according to claim 12, further comprising external information detecting means that can detect a change in refrigeration load as external information, wherein the electromagnetic force serving as a control target value is determined based on said external information, and the discharge capacity of said variable capacity compressor is feedback controlled such that the force exerted to said collision plate approaches said control target value.

31. An air conditioner according to claim 28, further comprising external information detecting means that can detect a change in refrigeration load as external information, wherein the electromagnetic force serving as a control target value is determined based on said external information, and the discharge capacity of said variable capacity compressor is feedback controlled such that the force exerted to said collision plate approaches said control target value.

* * * * *